US007305930B1

(12) United States Patent
Beal et al.

(10) Patent No.: US 7,305,930 B1
(45) Date of Patent: Dec. 11, 2007

(54) MARINE VESSEL VENT PLATE

(76) Inventors: Robert Wayne Beal, 9600 SW. Iowa Dr., Tualatin, OR (US) 97062; Thomas J Vincent, 1349 Westview Dr., Grants Pass, OR (US) 97527

( * ) Notice: Subject to any disclaimer, the term of this patent is extended or adjusted under 35 U.S.C. 154(b) by 0 days.

(21) Appl. No.: 10/844,910

(22) Filed: May 12, 2004

(51) Int. Cl.
*B63J 2/00* (2006.01)

(52) U.S. Cl. ..... 114/211

(58) Field of Classification Search ..... 114/211
See application file for complete search history.

(56) References Cited

U.S. PATENT DOCUMENTS 3,039,077 A * 6/1962 Lasky et al. ..... 367/173
3,307,186 A * 2/1967 Straub ..... 342/4
3,528,445 A * 9/1970 Czwakiel et al. ..... 137/833
5,161,478 A * 11/1992 Strieb ..... 114/361
5,664,349 A * 9/1997 White et al. ..... 38/97
5,744,213 A * 4/1998 Nelson ..... 428/131

* cited by examiner

*Primary Examiner*—Stephen Avila
(74) *Attorney, Agent, or Firm*—Ingrid McTaggart

(57) ABSTRACT

One embodiment of a vent plate for a marine vessel includes a plate having a top surface that defines a total surface area and a plurality of apertures arranged in a pattern covering at least one quarter of the total surface area, the pattern including a plurality of rows of apertures off-set by an angle of approximately forty five degrees.

33 Claims, 10 Drawing Sheets

MARINE VESSEL VENT PLATE

BACKGROUND

Marine vessel hulls may include openings for facilitating a flow of water through the vessel hull. These openings may allow a flow of water at any pressure and may be easily detectable by radar.

DETAILED DESCRIPTION OF THE DRAWINGS

Figure 1:
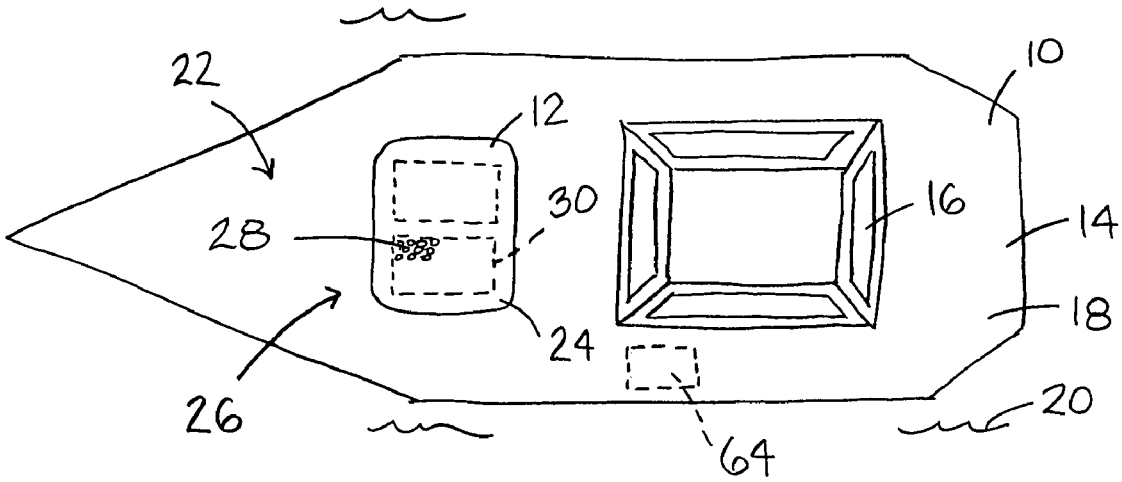
FIG. 1 is a top view of one embodiment of a marine vessel including one embodiment of a vent plate.

FIG. 1 is a top view of one embodiment of a marine vessel 10 including one embodiment of a vent plate 12. Vessel 10 may comprise any vessel adapted for use on or in water, such as a boat, a submarine, or a plane adapted for landing on water. In the embodiment shown, vessel 10 may comprise a boat and hull 14 may comprise a portion of vessel 10 that may come into contact with a body of water through which vessel 10 moves. Vessel 10 may include a hull 14 and a control area 16 for crew members or control components. Hull 14 may include an exterior surface 18 that may be generally streamlined and/or have a smooth surface so as to cut through the water during movement of vessel 10 therethrough. Vent plate 12 may be positioned anywhere on hull 14 but generally may be positioned on a region of hull 14 that may come into contact with water 20 surrounding hull 14 so that water 20 may flow or be pumped into hull 14 to decrease a buoyancy of hull 14 or may flow or be pumped out of hull 14 so as to increase a buoyancy of hull 14. Accordingly, hull 14 may include a compartment 22 in an interior thereof for receiving water therein. Vent plate 12 may define an outer or exterior surface 24 that may be positioned in a single plane 26 with an adjacent portion of outer surface 18 of hull 14 so that hull 14 may have a substantially streamlined and smooth exterior surface 18 during movement of hull 14 through air and/or body of water 20. Vent plate 12 may include a pattern of apertures 28 that may extend across a portion 30 (indicated by dash lines, wherein only a few apertures are shown in portion 30 for ease of illustration) of vent plate 12 wherein apertures 28 may allow water to flow therethrough, into and out of compartment 22 of hull 14.

Figure 2:
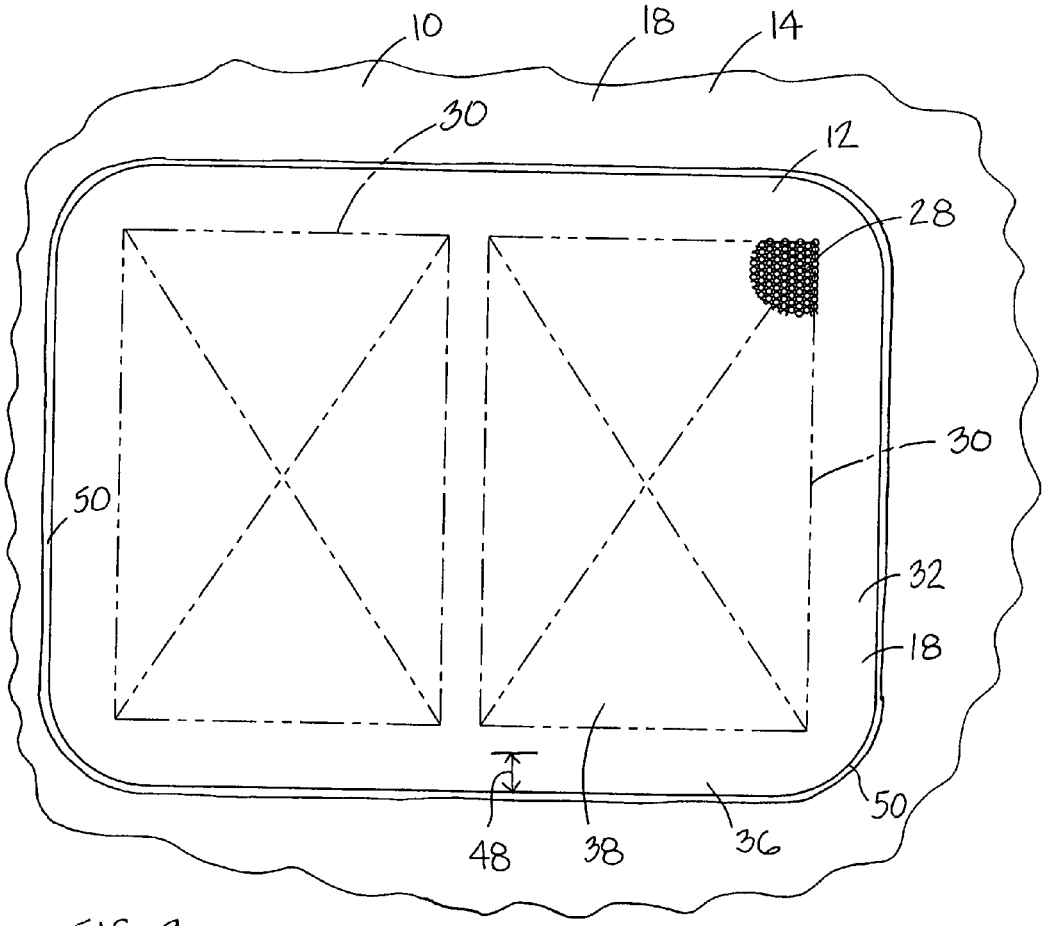
FIG. 2 is a top view of one embodiment of a vent plate.

FIG. 2 is a top view of one embodiment of vent plate 12 including pattern of apertures 28 extending across regions 30 of vent plate 12. In the figure, only a small section of apertures 28 are shown in one of regions 30 for ease of illustration. In one embodiment of vent plate 12, pattern of apertures 28 may extend throughout both of regions 30. Regions 30, including apertures 28 therein, may extend across at least one quarter of a total surface area 32 of exterior surface 24 of vent plate 12. In the embodiment shown, regions 30 extend across approximately three-quarters of total surface area 32 of exterior surface 24 of vent plate 12. In other embodiments, pattern of apertures 28 may extend across different portions and in different percentages of the total surface area 32. A single vent plate may include one or more portions 30 that may include a pattern of apertures 28 therein.

Figure 3:
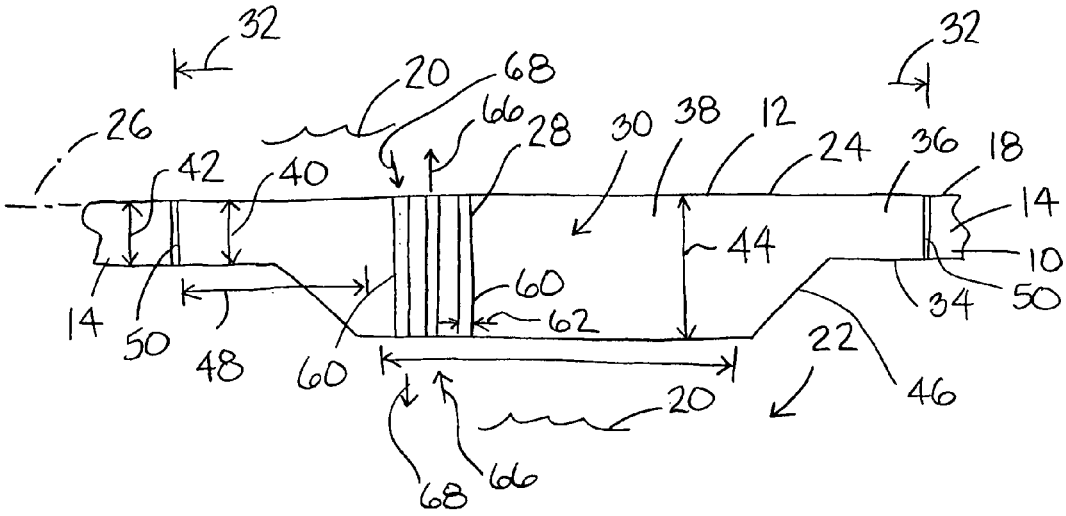
FIG. 3 is a side cross-sectional view of one embodiment of a vent plate secured to a marine vessel hull.

FIG. 3 is a side cross-sectional view of one embodiment of a vent plate 12 secured to marine vessel hull 14. Compartment 22 of hull 14 is shown on an interior side 34 of vent plate 12 and total surface area 32 of exterior surface 24 of vent plate 12 is shown in side view. Vent plate 12 may include an outer region 36 and an interior or central region 38. Outer region 36 may have a thickness 40 substantially similar to a thickness 42 of hull 14. In the embodiment shown, thickness 40 of outer region 36 of vent plate 12 and thickness 42 of hull 14 are both approximately one quarter (¼) inches (in). Central region 38 may have a thickness 44 greater than thickness 40 of outer region 36, wherein thickness 44 may be at least twice as thick as thickness 40 of outer region 36. In the embodiment shown, thickness 44 of central region 38 of vent plate 12 may be approximately one half (½) in. Central region 38 may be manufactured with a thickness 44 greater than a thickness 40 so that region 38 may be able to withstand a force upon vent plate 12 without appreciable deformation, such as from a person walking on the vent plate. Vent plate 12 may include a tapered region 46 positioned between outer region 36 and central region 38, wherein tapered region 46 may include a thickness that increases from outer region 36 to central region 38.

Still referring to FIG. 3, outer region 36 of vent plate 12 may include a width 48 that may be sufficient to dissipate heat during creation of a weld 50 that may be used to secure vent plate 12 to hull 14. Accordingly, due to width 48, heat stress that may be induced within the material of vent plate 12 in outer region 36 may not effect a strength of central region 38, including apertures 28 therein, of vent plate 12. In the embodiment shown, width 48 of outer region 36 of plate 12 may be approximately three (3) inches (in).

Pattern of apertures 28 may include several hundred, several thousand, or more, individual apertures 60 that may extend through thickness 44 of central region 38 of vent plate 12. For ease of illustration, three apertures 60 are shown. Apertures 60 may have any cross-section shape, such as a square, a rectangular, a circle, a truncated triangle, a triangle, an abstract or unsymmetrical shape, or the like. Individual apertures 60 within a single pattern 28 may not all have the same shape, size, or exit angle such that a single pattern of apertures 28 may include multiple shapes and sizes of individual apertures. In the embodiment shown, individual apertures 60 each have a substantially similar shape and size such as a substantially cylindrical cross-sectional shape with a length 44 and a width 62. Apertures 60 are shown extending substantially perpendicular to exterior surface 24 of vent plate 12. In another embodiment, apertures 60 may extend through vent plate 12 at any angle to exterior surface 24, such as at an angle of approximately 45°. In such an embodiment, where apertures 60 are around in cross-sectional shape and extend at an angle of 45° to surface 24, the apertures would extend through surface 24 in an elliptical shape.

During periods when compartment 22 within hull 14 may be pressurized to a pressure greater than atmospheric pressure by a pressuring device such as a pump 64 (shown schematically in FIG. 1), water 20, if present within compartment 22, may flow outwardly of hull 14 through apertures 60 in direction 66. During periods when compartment 22 within hull 14 may be pressurized to a pressure less than atmospheric pressure by a pressuring device such as a pump 64 (see FIG. 1), water 20, if present outside hull 14 and adjacent vent plate 12, may flow inwardly into hull 14 through apertures 60 in direction 68. During periods when compartment 22 and an exterior of hull 14 may be at atmospheric pressure, the size and shape of pattern of apertures 28 may inhibit or reduce the tendency of water 20 to flow through apertures 60 such that pattern 28 may provide a sheeting action and/or a surface tension such that water 20 may not flow through apertures 20. Accordingly, pattern of apertures 28 of vent plate 12 may increase the streamlined efficiency of hull 14 as it moves through a body of water 20 under non-pressurized conditions.

In the embodiment shown, vent plate 12 may be secured to hull 14 such that exterior surface 24 of vent plate 12 may be positioned substantially in single plane 26 with exterior surface 18 hull 14. In other words, plane 26 of top surface 24 of plate 12 may be positioned from the plane of exterior surface 18 of hull 14 a vertical distance of not more than 0.25 in as measured along the direction of thickness 40. Such substantial single plane positioning of vent plate 12 within hull 14 may inhibit or reduce detection of vent plate 12 by a radar system. Vent plate 12, hull 14 and weld 59 may all be manufactured of a conductive material, such as a metal, namely, aluminum. Vent plate 12, together with weld 50, therefore, may define a substantially continuous electrical conductivity path across vent plate 12 and hull 14. Moreover, pattern of apertures 28 may define a plurality of relatively small individual apertures 60 that may inhibit or reduce detection of apertures 60 by a radar system. Accordingly, vent plate 12 may allow water to flow into and out of hull 14 without providing a relatively large vent opening that may be easily detected by a radar system. In other words, vent plate 12 may maintain radar signature boundaries such as maintaining conductivity, and such as reducing structural steps and gaps (i.e., reducing structural vertical discontinuities or horizontal discontinuities), such that vent plate 12, and hull 14, is not easily detected by a radar system.

Figure 4:
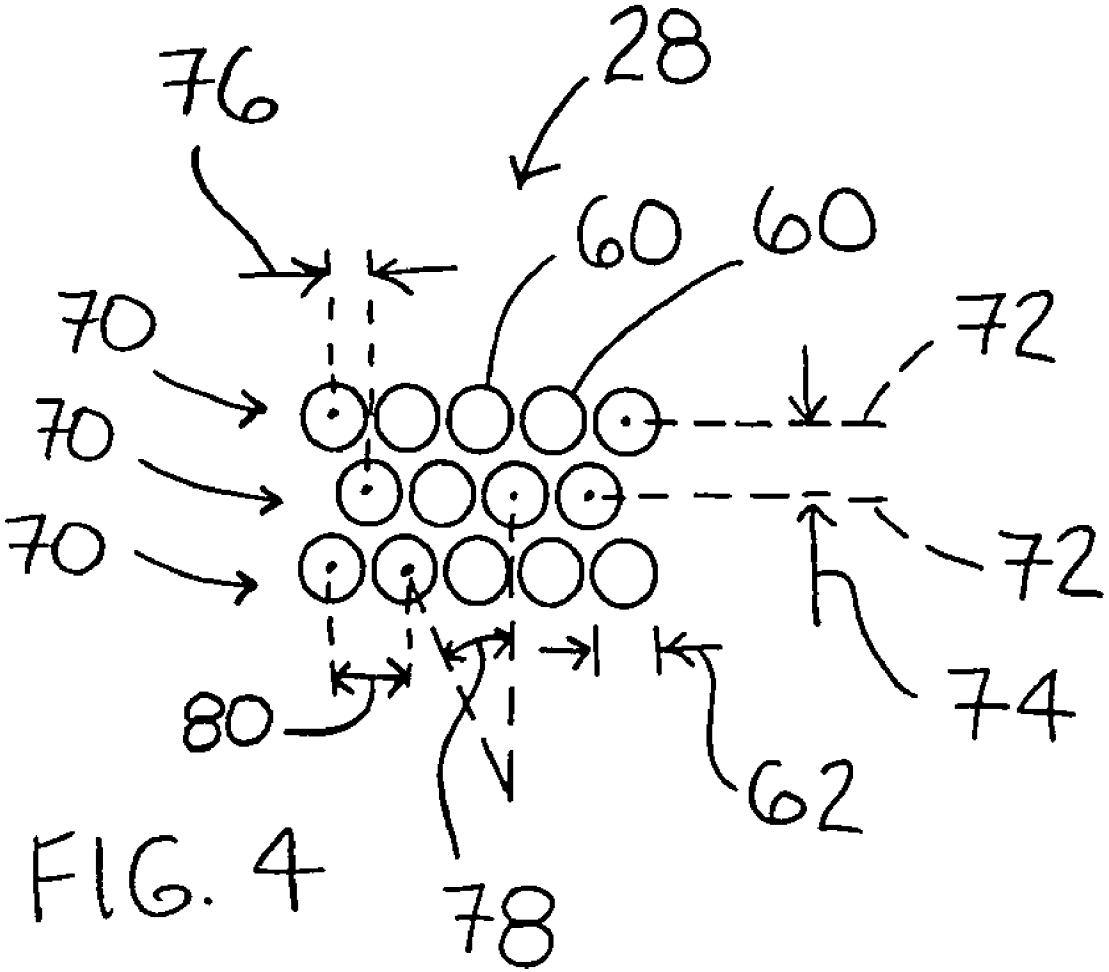
FIG. 4 is a detail view of one embodiment of an aperture pattern of one embodiment of a vent plate.

FIG. 4 is a detail view of one embodiment of an aperture pattern 28 of one embodiment of a vent plate 12. Pattern of apertures 28 may include a plurality of rows 70 of individual apertures 60 wherein a centerline 72 of adjacent rows may be separated by a centerline-to-centerline distance 74. Adjacent rows 70 may have an aperture center-to-center offset 76. Accordingly, each of adjacent rows 70 may be offset by an acute angle 78. Each of apertures 60 within a single row 70 may have a center-to-center separation 80. In the embodiment shown, each of individual apertures 60 may have a width, such as a diameter 62, of less than 0.25 inches, or less than 0.20 inches, or greater than 0.18 inches. Adjacent rows 70 may have an centerline-to-centerline offset 74 of less than 0.25 inches, or less than 0.23 inches, or greater than 0.20 inches. Adjacent rows 70 may have an aperture center-to-center separation 76 of less than 0.25 inches, or less than 0.12 inches, or greater than 0.10 inches. Adjacent rows 70 may by off set by an acute angle 78 of eight-nine degrees or less, such as forty-five degrees. Adjacent apertures 60 may be separated by a distance 80 of 0.25 in or less. In one particular embodiment, apertures 60 may have a diameter 62 of approximately 0.1875 inches, centerline-to-centerline offset 74 of rows 70 may be approximately 0.219 inches, center-to-center offset 76 of rows 70 may be approximately 0.109 inches, acute angle 78 may be approximately forty-five degrees, and center-to-center spacing 80 of apertures 60 within a row 70 may be 0.219 inches. These particular dimensions are believed to create a sheeting effect of water over pattern 28 at pressures substantially equal to atmospheric pressure such that vent plate 12 may provide a streamlined exterior surface for hull 14 while not appreciably increasing a radar detectability of the hull.

Figure 5:
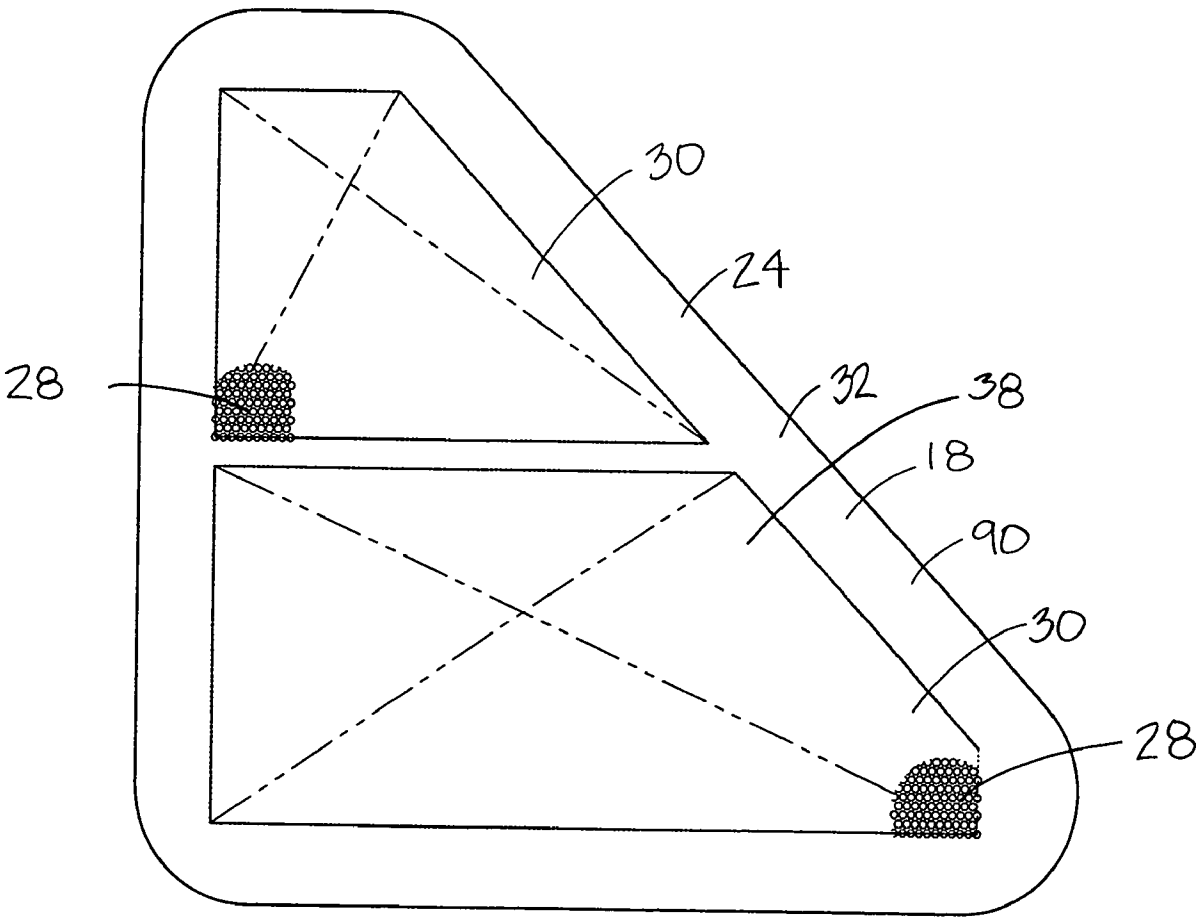
FIG. 5 is a top view of another embodiment of a vent plate.
Figure 6:
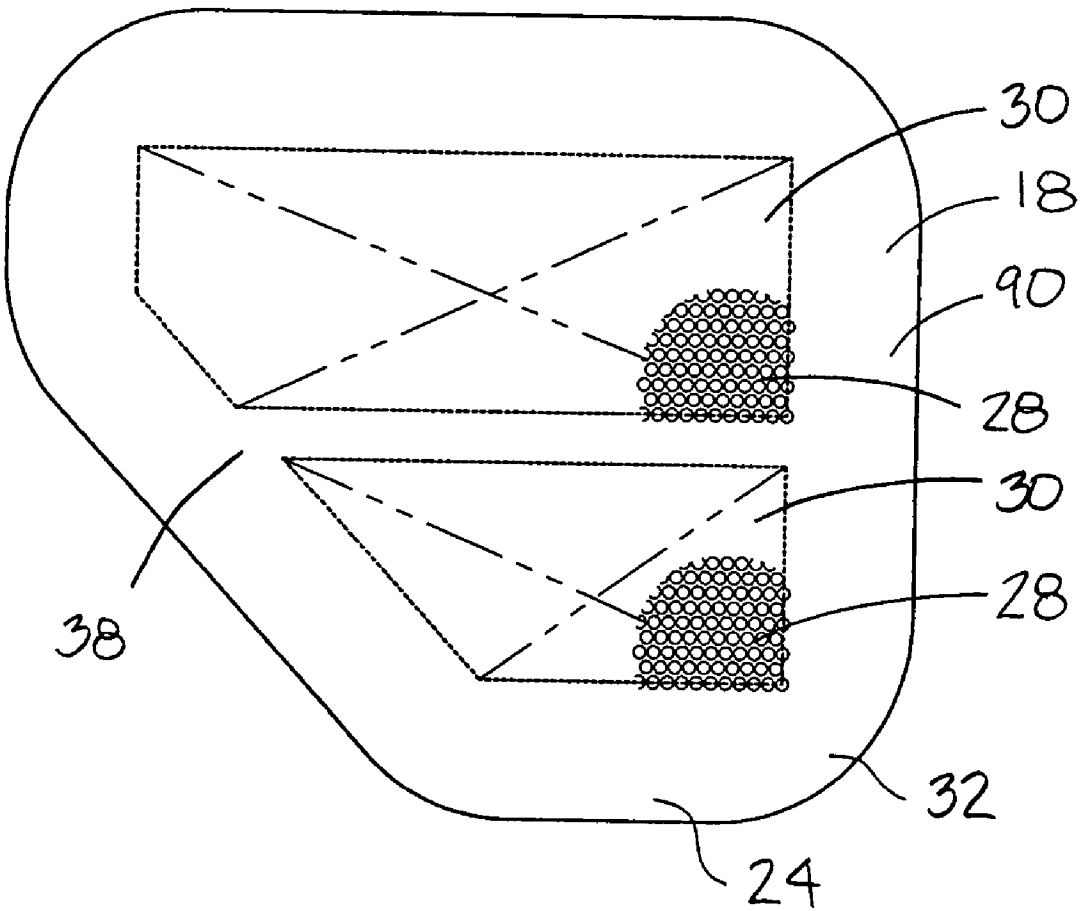
FIG. 6 is a top view of another embodiment of a vent plate.
Figure 7:
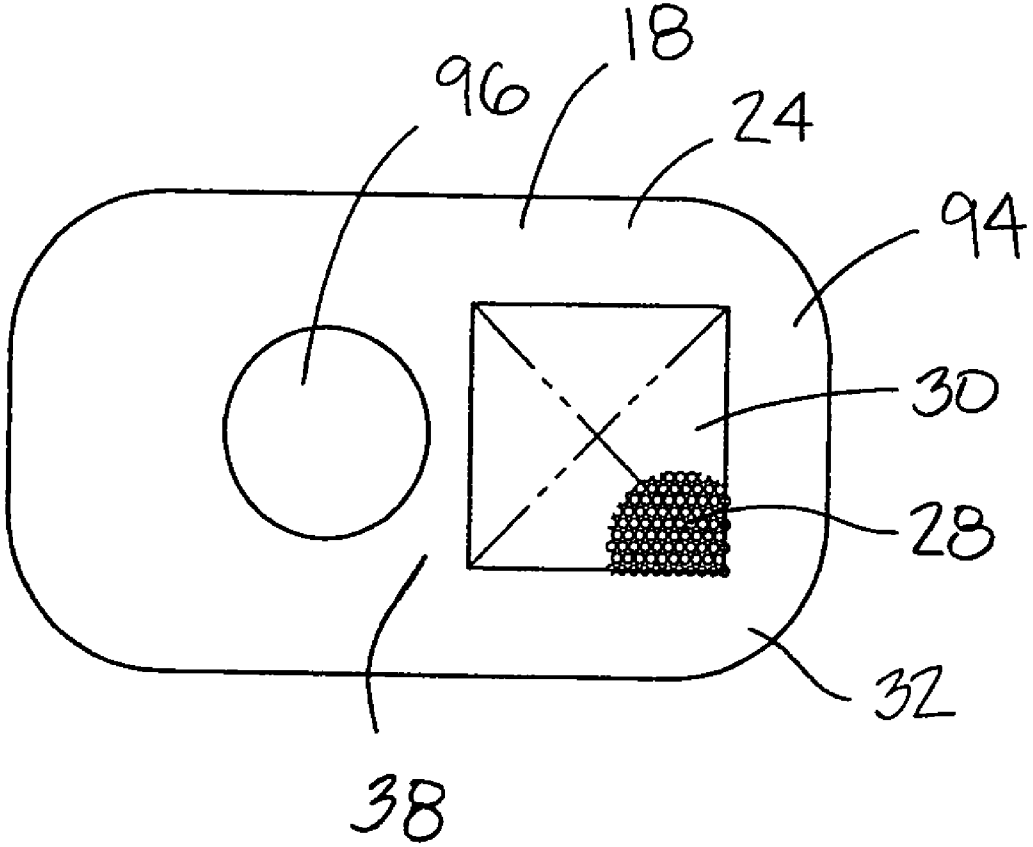
FIG. 7 is a top view of another embodiment of a vent plate including a fuel cap.
Figure 8:
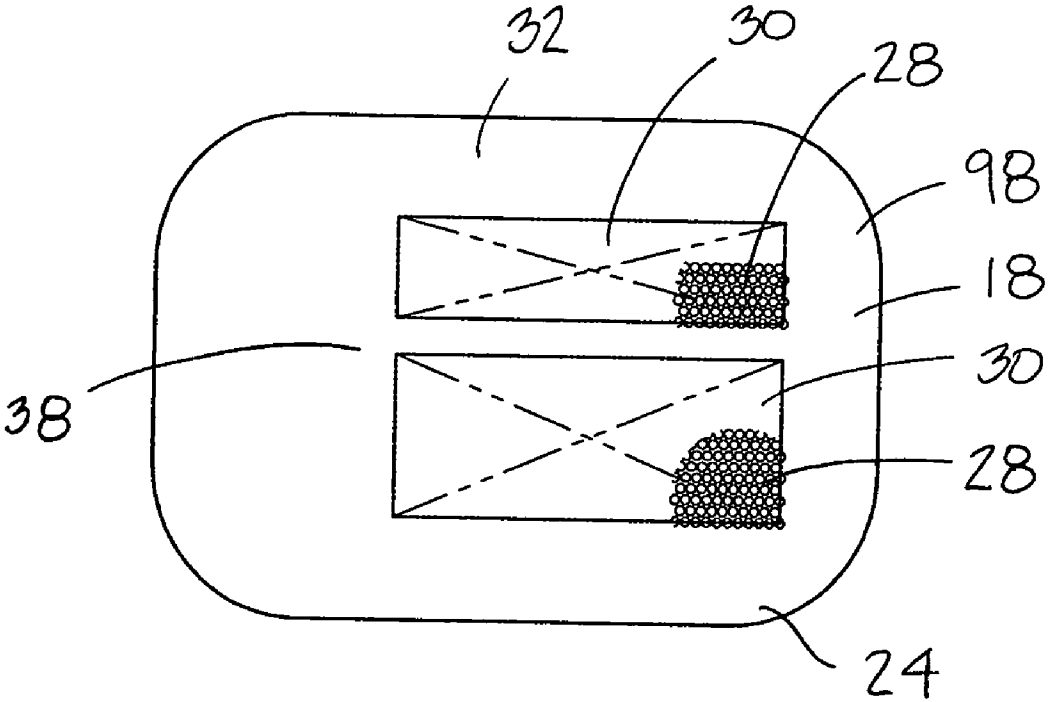
FIG. 8 is a top view of another embodiment of a vent plate.
Figure 9:
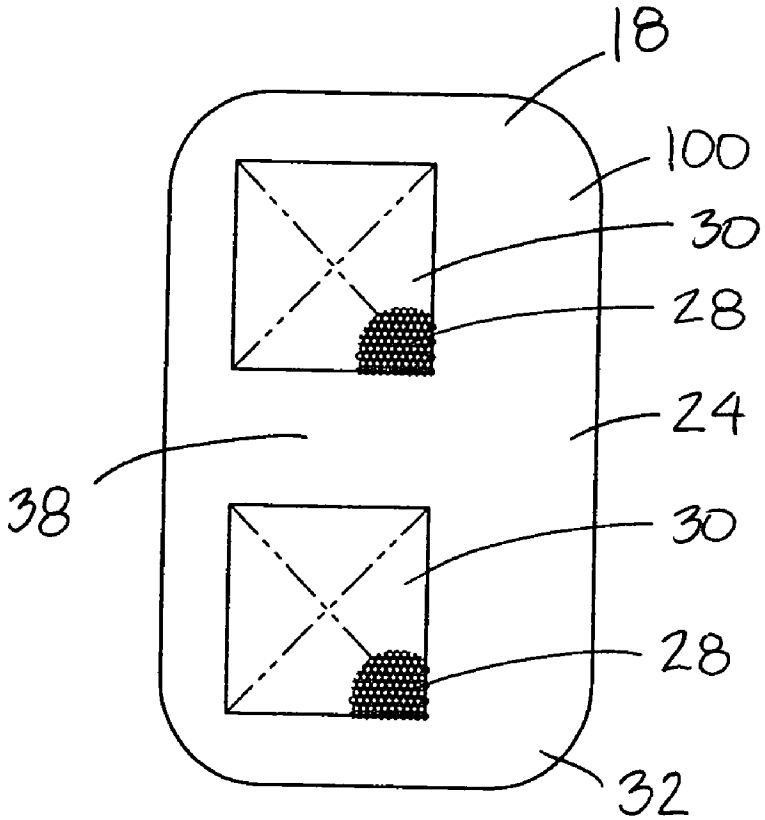
FIG. 9 is a top view of another embodiment of a vent plate.
Figure 10:
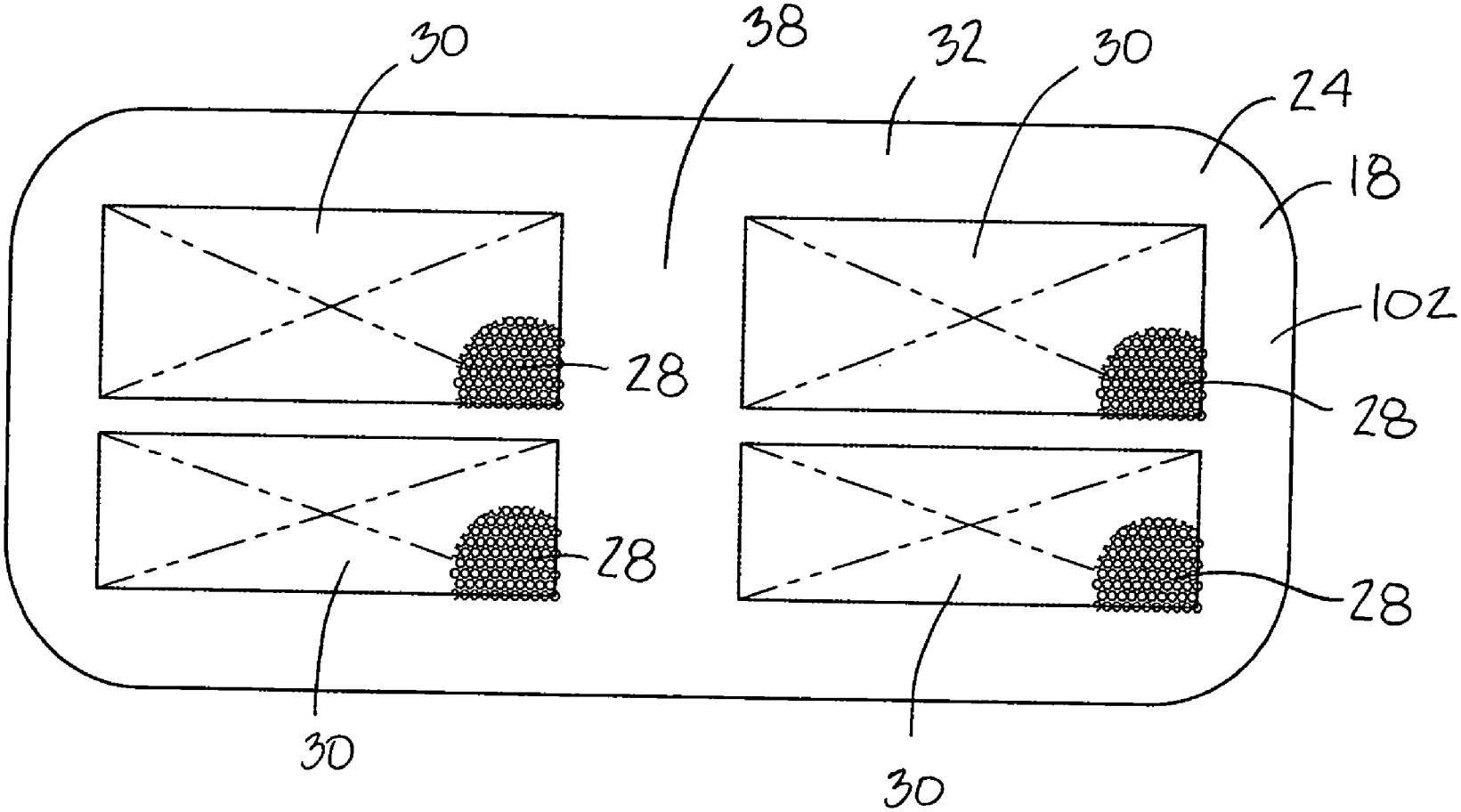
FIG. 10 is a top view of another embodiment of a vent plate.

FIGS. 5-10 show top views of other embodiments of a vent plates. FIG. 5 shows a vent plate 90 having a substantially truncated triangle shape. FIG. 6 shows a vent plate 92 having a substantially triangle shape. FIG. 7 shows a vent plate 94 including a pattern of apertures 28 in portion 30 and a fuel cap 96. Fuel cap 96 may be a component of vent plate 12 and may be positioned in the plane of exterior surface 24 of vent plate 12. FIG. 8 shows a vent plate 98 have a substantially oval shape. FIG. 9 shows a vent plate 100 have a substantially rectangular shape. FIG. 10 shows a vent plate 102 have a substantially rectangular shape.

Other variations and modifications of the concepts described herein may be utilized and fall within the scope of the claims below.

We claim:

1. A vent plate for a marine vessel, comprising:

a plate including:

a top surface that defines a total surface area; and a plurality of apertures arranged in a pattern covering at least one quarter of said total surface area, said pattern comprising a plurality of rows of apertures off-set by an angle of approximately forty five degrees, wherein said plate has an outer region and a central region, wherein said plurality of apertures are positioned in said central region, and wherein said central region has a thickness greater than a thickness of said outer region.

2. A vent plate according to claim 1 wherein said apertures each define a width of less than 0.25 inches.

3. A vent plate according to claim 1 wherein said apertures each define a diameter of less than 0.20 inches.

4. A vent plate according to claim 1 wherein said rows of apertures define a centerline-to-centerline separation of less than 0.25 inches.

5. A vent plate according to claim 1 wherein said apertures within a row each define a center-to-center separation of less than 0.25 inches.

6. A vent plate according to claim 1 wherein said apertures are sized and arranged so as to define a sheeting effect over said plate such that at atmospheric pressure water flows over said apertures.

7. A vent plate according to claim 1 wherein said apertures are sized and arranged so as to facilitate a flow of water through said apertures at pressures other than atmospheric pressure.

8. A vent plate according to claim 1 wherein said outer region has a width sufficient to reduce heat induced stress from reducing a strength of said central region when said outer region of said plate is welded to a marine vessel hull.

9. A vent plate for a marine vessel, comprising:

a plate including:

a top surface that defines a total surface area; and a plurality of apertures arranged in a pattern covering at least one quarter of said total surface area, said pattern comprising a plurality of rows of apertures off-set by an angle of approximately forty five degrees, wherein said plate has an outer region and a central region, wherein said plurality of apertures are positioned in said central region, and wherein said central region has a thickness greater than a thickness of said outer region, wherein said pattern is substantially undetectable by radar.

10. A vent plate according to claim 1 wherein said plate is welded into an aperture of a marine vessel hull such that said plate becomes a component of said hull and such that said top surface of said plate is positioned in a plane of an exterior surface of said hull.

11. A vent plate for a marine vessel, comprising:

a plate including:

a top surface;

a thickness; and a plurality of apertures arranged in a pattern on said top surface and extending through said thickness of said plate, wherein each of said apertures define a width of less than 0.25 inches, wherein said plate is welded into an aperture of a marine vessel hull such that said plate becomes a component of said hull and such that said top surface of said plate is positioned in a plane of an exterior surface of said hull.

12. A vent plate according to claim 11 wherein said apertures are cylindrical in shape.

13. A vent plate according to claim 11 wherein said plurality of apertures comprises at least one hundred apertures.

14. A vent plate according to claim 11 wherein said pattern includes a plurality of rows of apertures wherein each row of apertures is offset from one another by a distance of less than 0.12 inches and greater than 0.10 inches.

15. A vent plate according to claim 11 wherein said pattern includes a plurality of rows of apertures wherein a center line of each row of apertures is spaced apart from adjacent centerlines a distance of greater than 0.20 inches and less than 0.23 inches.

16. A vent plate according to claim 11 wherein each of said apertures defines a diameter of greater than 0.18 inches and less than 0.20 inches.

17. A marine vessel, comprising:

a hull including an aperture therein;

a vent plate secured within said aperture of said hull, said vent plate including a plurality of vent openings sized and arranged so as to create a sheeting effect over said vent openings such that substantially no water flows through said vent openings at atmospheric pressure, wherein said vent plate and said hull are both manufactured of an electrically conductive material, and wherein said vent plate is secured to said hull so as to define a continuous electrical conductivity path from said hull and through said vent plate.

18. A marine vessel according to claim 17 wherein said vent openings are sized and arranged so as to facilitate flow of water through said vent openings at pressures other than atmospheric pressure.

19. A marine vessel according to claim 17 wherein said hull defines an exterior surface and said vent plate defines an exterior surface, and wherein said exterior surface of said hull and said exterior surface of said vent plate are positioned substantially in a single plane.

20. A marine vessel according to claim 19 wherein said hull has a thickness, wherein said vent plate has a thickness in an outer region thereof and a thickness in a central region thereof, and wherein said thickness of said vent plate in said outer region is substantially the same as said thickness of said hull, and said thickness of said vent plate in said central region is at least twice the thickness of said outer region.

21. A marine vessel according to claim 17 wherein said vent plate is welded to said hull.

22. A marine vessel according to claim 17 wherein said vent plate further includes a fuel cap.

23. A method of flowing water through a marine vessel hull, comprising:

providing a plurality of apertures in a wall of said hull, said plurality of apertures sized and spaced so as to reduce a flow of water through said apertures at atmospheric pressure and so as to increase a flow of water through said apertures at pressures other than atmospheric pressure; and providing a pressure other than atmospheric pressure within said hull so as to facilitate a flow of water through said apertures.

24. A method according to claim 23 wherein said providing a pressure comprises providing a pressure within said hull of less than atmospheric pressure such that water flows into said hull through said apertures.

25. A method according to claim 23 wherein said providing a pressure comprises providing a pressure within said hull of greater than atmospheric pressure such that water flows out of said hull through said apertures.

26. A method according to claim 23 wherein said providing a plurality of apertures comprises providing a vent plate including said plurality of apertures therein, and further comprising welding said vent plate to an opening of said hull.

27. A marine vessel, comprising:

means for venting water through a hull of said marine vessel, wherein said means for venting water is sized so as to reduce a flow of water through said means for venting at atmospheric pressure and so as to increase a flow of water through said means for venting at pressures other than atmospheric pressure; and means for pressuring said hull so as to facilitate flow of water through said means for venting.

28. A marine vessel according to claim 27 wherein said means for venting comprises a vent plate including a pattern of apertures therein, said apertures sized so as to reduce a flow of water through said means for venting at atmospheric pressure and so as to increase a flow of water through said means for venting at pressures other than atmospheric pressure.

29. A marine vessel according to claim 27 wherein said means for venting provides a continuous electrical conductivity path across said hull.

30. A marine vessel according to claim 27 wherein said means for pressuring comprises a pump.

31. A marine vessel comprising:

a marine hull including an outer surface;

a vent plate welded to said hull wherein an outer surface of said vent plate is positioned in a single plane with said outer surface of said hull, said vent plate including a pattern of apertures therein, said apertures being cylindrical in shape and arranged in rows, each row defining a centerline-to-centerline spacing of less than 0.25 inches and defining a center-to-center offset of less than 0.25 inches, and wherein said pattern of apertures extends across at least one quarter of said outer surface of said vent plate.

32. A marine vessel according to claim 31 wherein said vent plate has a shape chosen from one of a substantially rectangular shape, a substantially oval shape, a substantially triangular shape, and a substantially truncated triangular shape.

33. A marine vessel according to claim 31 wherein said pattern includes at least one thousand apertures.

* * * * *